United States Patent [19]

Kennedy

[11] 4,160,966

[45] Jul. 10, 1979

[54] STABILIZED REACTOR

[75] Inventor: Theodore R. Kennedy, Willingboro, N.J.

[73] Assignee: Inductotherm Corp., Rancocas, N.J.

[21] Appl. No.: 830,733

[22] Filed: Sep. 6, 1977

[51] Int. Cl.[2] ..... H01F 21/08

[52] U.S. Cl. ..... 336/155; 336/178; 336/212; 336/233

[58] Field of Search ..... 323/89 C, 89 AG; 365/58, 60; 336/233, 234, 221, 178, 212, 155, 160, 165, 213, 229

[56] References Cited

U.S. PATENT DOCUMENTS

| | | | |
|---|---|---|---|
| 1,182,997 | 5/1916 | Fondiller | 336/178 |
| 1,318,787 | 10/1919 | Mollerhoj | 336/234 X |
| 2,825,892 | 3/1958 | Duinker | 336/221 X |
| 3,315,087 | 4/1967 | Ingenito | 336/233 |
| 3,748,618 | 7/1973 | Kaiserwerth et al. | 336/178 |

FOREIGN PATENT DOCUMENTS

| | | | |
|---|---|---|---|
| 2405689 | 8/1975 | Fed. Rep. of Germany | 336/178 |
| 884431 | 12/1961 | United Kingdom | 336/233 |
| 1096527 | 12/1967 | United Kingdom | 336/234 |

*Primary Examiner*—Thomas J. Kozma

*Attorney, Agent, or Firm*—Seidel, Gonda, Goldhammer & Panitch

[57] ABSTRACT

A stabilized saturated reactor comprising a solid toroidal core of magnetic material. The core has at least one end face provided with plural circumferentially spaced slots. Each slot extends in a substantially radial plane with respect to the central axis of the core. Each slot has a width substantially less than the cross-sectional dimensions of the core. The core may have a second end face which is provided with plural slots staggered circumferentially in relation to the slots in the other end face to simulate a linear reactor. The core, with both end faces slotted, may be combined under a common winding with an unslotted saturated toroidal core spaced therefrom to simulate the stabilized saturated reactor core having only one slotted end face.

8 Claims, 6 Drawing Figures

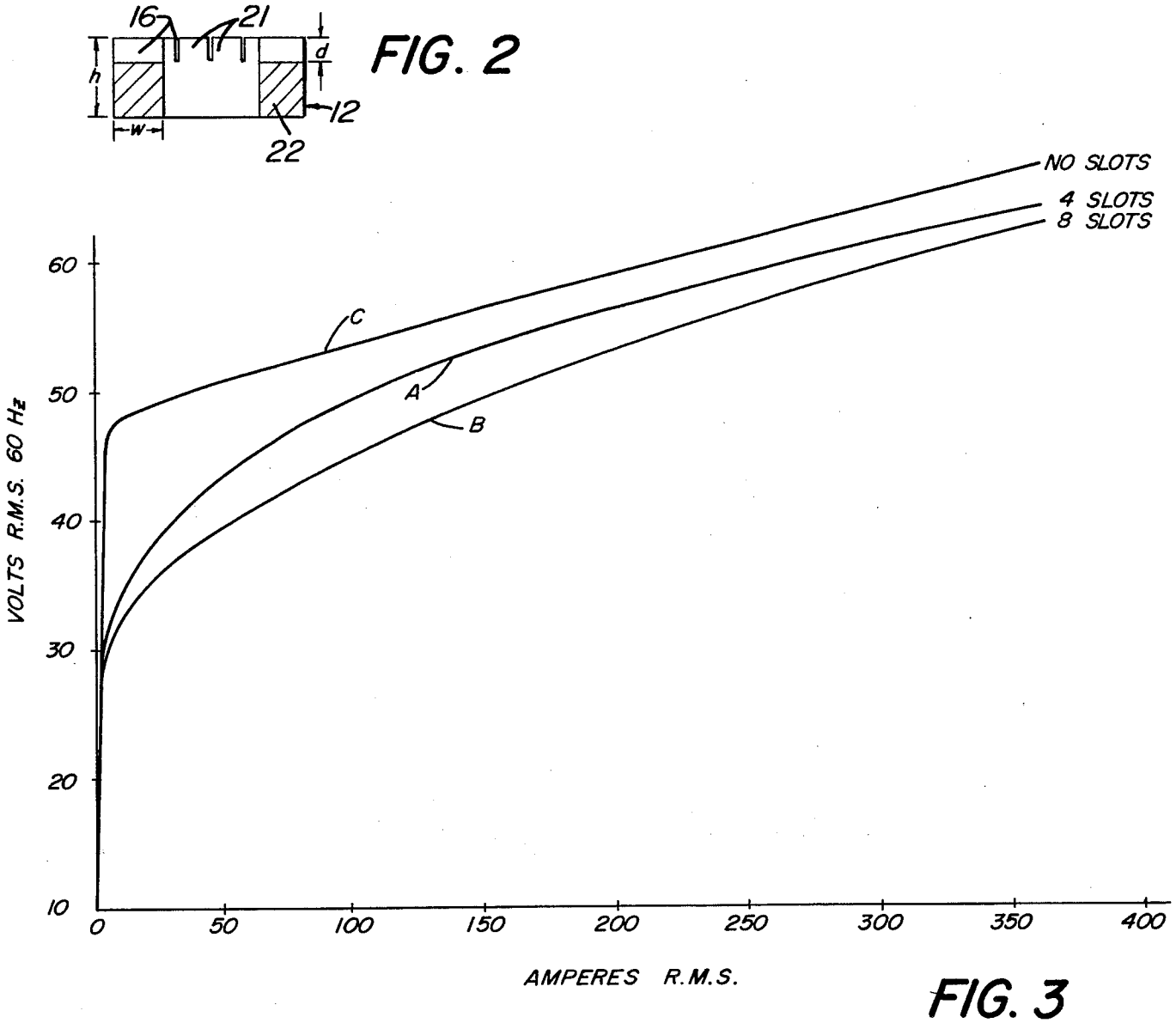
FIG. 2
FIG. 3
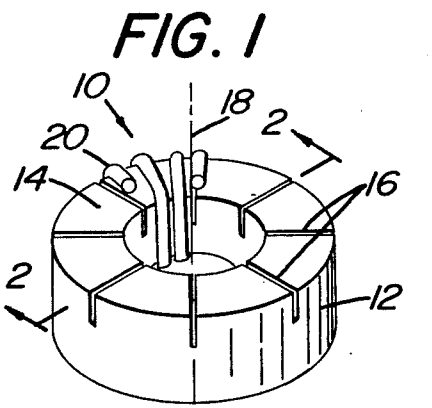
FIG. 1
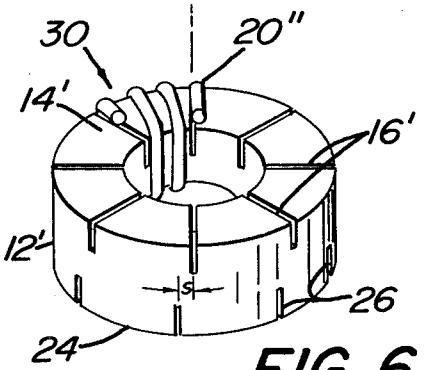
FIG. 6

STABILIZED REACTOR

BACKGROUND OF THE INVENTION

This invention is directed to a structural arrangement for reactor cores. In particular, the invention is directed to a core arrangement for stabilizing saturated reactors and for simulating a linear reactor. The invention is not directed to a saturable reactor. Saturable reactor cores must be designed to account for a bias current winding. The present invention operates off AC line without bias current.

Slotted core formations for reactors are well known in the art. For example, see U.S. Pat. Nos. 2,907,957, 3,150,340 and 1,606,777. In general, the number, size and location of slots in a magnetic core is determined by the intended application for the core. In U.S. Pat. No. 2,907,957, there is described a saturable magnetic core for use in an electrically variable delay line. The core must have a substantially linear inductance versus bias current curve. Signal loss should be minimized. The magnetic core is provided with a circumferential notched portion which supports two oppositely poled signal windings. The purpose of the notch is to confine the signal field to a restricted portion of the core to reduce losses in the energy field due to the core itself. The bias current winding is wrapped around a remaining portion of the core.

Restriction of the signal field can be enhanced by forming a narrow slot at each end of the notch. These narrow slots enable a substantially linear inductance versus bias current curve to be attained. The inductance of the reactor is varied by varying the bias current. The bias current determines the incremental permeability of the magnetic core and, therefore, the reactance of the core to relatively low amplitude alternating current signals.

There are many instances where a reactor must operate in a reasonably stable manner although in a magnetically saturated condition. For example, a reactor operating off an AC line without bias current may be driven deep into saturation under relatively high alternating voltage and current conditions. Minor fluctuations in the applied alternating voltage may result in current swings 20 times greater. This instability of the saturated reactor imposes a severe burden on the power supply. In addition, it results in objectionable deviation from impedance and power factor balance conditions.

Heretofore, a saturated reactor operating off AC line could be stabilized by connecting a linear choke in series with the reactor. The choke would be rated at the same current as the saturated reactor and would produce a voltage drop sufficient to introduce the required degree of stability in the reactor. Where the energy levels under consideration were as high as hundreds or even thousands of KVA, the design of an effective linear choke became quite involved and expensive.

A technique for simulating a series choke for a saturated reactor is disclosed in U.S. Pat. No. 3,295,050 assigned to the assignee herein. The magnetic core was surrounded by a bonded, powdered iron structure having a generally linear magnetic characteristic. A common winding surrounded the entire assembly. The powdered iron was arranged in a ring and was dimensioned to introduce the necessary degree of electrical stability to the assembly.

The bonded rings disclosed in U.S. Pat. No. 3,295,050 performed satisfactorily in stabilizing the saturated reactor. The assembly, however, suffered from certain objectionable features such as excess heating due to losses in the bonded ring, marked magnetic saturation in the ring, and unavoidably high labor costs in assembling the core and bonded ring to form the final reactor.

To date, there is a compelling need for a magnetic core structure for a saturated reactor operable off AC line without objectionable instability. Such a core structure should be relatively simple to assemble and should minimize the costs of manufacture. The core should also exhibit mechanical strength and integrity.

BRIEF SUMMARY OF THE INVENTION

A stabilized saturated reactor comprising a core of magnetic material. The core has at least one end face provided with plural circumferentially spaced slots extending in a substantially radial plane with respect to the central axis of the core. Each of the slots has a width substantially less than the cross-sectional dimensions of the core. The second end face of the core may also be provided with spaced slots staggered circumferentially with respect to the slots in the other end face.

An advantage of the invention is that the reactance is highly stable under saturated core conditions.

Another advantage of the invention is that the core structure exhibits good mechanical strength and integrity.

A further advantage of the invention is that it is relatively inexpensive to manufacture.

Further advantages will appear hereinafter.

BRIEF DESCRIPTION OF THE DRAWINGS

For the purpose of illustrating the invention, there are shown in the drawings forms which are presently preferred, it being understood, however, that this invention is not limited to the precise arrangements and instrumentalities shown.

FIG. 1 is an isometric drawing of one embodiment of a stabilized saturated reactor.

FIG. 2 is a cross-sectional view taken along the lines 2—2 in FIG. 1.

FIG. 3 is a graph of rms voltage versus rms current for an unstabilized saturated reactor, a stabilized saturated reactor having four slots, and a stabilized saturated reactor having eight slots.

FIG. 6 is an isometric drawing of a linear reactor.

DETAILED DESCRIPTION OF THE INVENTION

Figure 4:
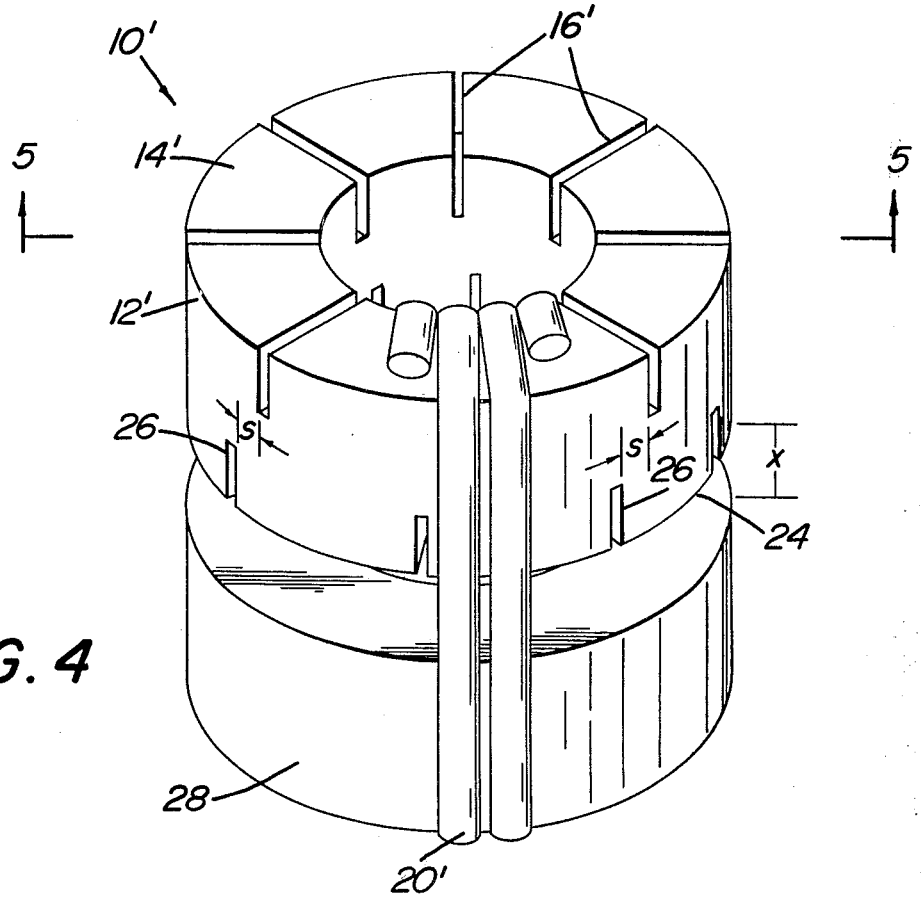
FIG. 4 is an isometric drawing of another embodiment of a stabilized saturated reactor.

Referring to the drawings in detail, wherein like numerals indicate like elements, there is shown in FIG. 1 a stabilized saturated reactor 10 constructed in accordance with the principles of the present invention. Reactor 10 comprises a toroidal core 12. Torroidal core 12 may comprise spirally wound magnetic steel strips. Alternatively, the core may be made of molded or ground ferrites.

The toroidal core 12 has an annular end face 14. Circumferentially spaced slots 16 are machined into the end face 14. Each slot 16 lies in a plane which extends in a substantially radial direction with respect to the central axis 18 of the core 12.

The slots 16 are extremely narrow relative to the cross-sectional dimensions of height h and width w of the core. See FIG. 2. It is important that the slots 16 be relatively narrow and that the width of the slots be substantially less than the cross-sectional dimensions of the core to minimize magnetic fringing effects.

A winding 20 is wrapped around the core 12. See FIG. 1. The winding is not seated in any of the slots 16 as the slots are too narrow to accept the winding. The winding carries relatively high amplitude alternating voltages and currents. In use, the winding 20 is connected to an AC source which drives the core 12 deep into saturation. Flux densities of approximately 20 K lines are typically produced in the core 12.

The depth d of each slot 16 is chosen to prevent saturation of the volume 21 of the core 12 located between the slots 16. The depth d may vary but, typically, the depth is less than one-half the height of the core. The unsaturated portion of the core 12 should be sufficiently large to attain substantial stabilization of the reactor 10 under normal operating conditions. Under such conditions, the portion 22 of the core 12 lying below the depth d of the slots 16 will be saturated. The unsaturated and saturated portions 21 and 22 of the core 12 are surrounded by the common winding 20. The unsaturated portion 21 is equivalent to a linear choke. The saturated portion 22 is equivalent to an unstabilized saturated reactor core. The reactor 10, then, will be equivalent to a series connection of a linear choke and saturated reactor. The overall effect produced by the reactor 10, therefore, will be that of a stabilized saturated reactor.

The rms voltage-current characteristic of the reactor 10 for varying numbers of the slots 16 is shown in FIG. 3. Curve C corresponds to an unslotted toroidal saturated reactor driven at 60 hz. The core of the saturated reactor was wound of 3 inch wide by 0.004 inch thick magnetic strip. The ID of the toroid was 3 inches and the OD was 4 inches. The core was not provided with any slots. The winding is comprised of 67 turns of #10 magnet wire. The slope of the saturated portion of the curve C is approximately 19.2.

The same toroidal core was provided with 4 slots circumferentially spaced 90° apart. Each of the slots had a depth of 1 3/16 inches and a width of 5/32 inch at the end face of the core and a width of ⅛ inch at the bottom of the slot. This produced a voltage-current curve A having a much more gradual rate of change at the knee.

The same core was also provided with 8 slots circumferentially spaced 45° apart. This produced a voltage-current curve B having a slope of approximately 12.8 in the saturated range.

Thus, the circumferentially spaced slots in the end face of the core produced marked stabilization of the saturated reactor.

At the lower ranges of saturation, the core reactance is due to the diversion of magnetic flux from the unsaturated section of the core to the saturated section. At these ranges of saturation, the saturated portion of the core retains a fair degree of magnetic permeability. The diversion of flux to the saturated section does not appear to be objectionable.

If necessary, however, the magnetic effects of the saturated and unsaturated portions of the reactor can be separated by constructing the stabilized saturated reactor 10' as shown in FIG. 4. A toroidal core 12' is provided with plural circumferentially spaced slots 16' machined into its end face 14'. The core 12' may be wound of steel strips or it may be made of molded or ground ferrites. The other end face 24 of the core 12' is provided with circumferentially spaced slots designated 26.

The slots 16' and the slots 26 are preferably equal in number, depth and width and are circumferentially spaced at equal intervals along the end faces 14' and 24 of the toroidal core. The slots 16' and the slots 26 are staggered circumferentially with respect to each other by the distance S. The portion of the core connecting the slots 16' and the slots 26 maintains the mechanical strength of the core. Thus, the core 10' is a unitary structure and requires no mechanical connecting elements such as compression bolts and wedging devices.

The core 10' is combined with an unslotted saturated reactor core 28 under a common winding 20' to provide a stabilized saturated reactor 10' equivalent to the stabilized saturated reactor 10 shown in FIG. 1. Preferably, the cores 12' and 28 are spaced apart by a distance x which is approximately 4 times the width of the slots 16', 26 to minimize magnetic leakage between the cores.

Figure 5:
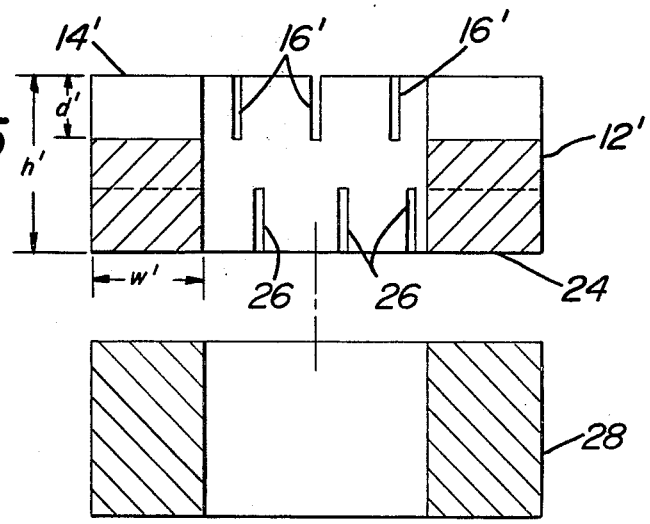
FIG. 5 is a cross-sectional view taken along the lines 5—5 in FIG. 4.

The circumferential stagger distance S should be as small as possible while ensuring good mechanical integrity of the core 12'. Preferably, the depth of the slots 16' and the slots 26 is approximately one-half the height h' of the core 12'. See FIG. 5. This provides the effect of a core slotted completely through its cross-section while maintaining the unitary mechanical structure of the core.

The slots 16' and 26 should be relatively narrow. The width of the slots should be substantially less than the cross-sectional dimensions of the toroidal core 12' for the reasons already enumerated in connection with the reactor 10 shown in FIG. 1. For slots approximately ⅛ inch in width, a stagger distance S of approximately ⅛ inch has been found to provide adequate mechanical integrity of the core using conventional magnetic steels.

The core 12' shown in FIG. 6 may also be used apart from core 28 to provide a linear reactor 30. See FIG. 6. The core 12' is surrounded by a winding 20''. In use, the winding 20'' is driven off an AC line. The linear reactor 30 can be used as an AC choke in any suitable application. The reactance of the reactor 30 is given by the equation:

$$R=200.4\times f\times n^2\times h'\times w'\times e\times 10^{-9}/g\times N$$

where n is the number of turns of the winding 20'', h' is the height of the toroidal core, w' is the width of the torodial core, g is the slot width, N is the number of slots per end face and e is a magnetic fringing factor. It can be shown that the magnetic fringing factor e is given by:

$$e=1+3.8[g(h'+w')/h'\times w']$$

The slot with g should be substantially less than the cross-sectional dimensions h' and w' of the toroidal core to minimize the magnetic fringing factor e.

An advantage of the invention is that it is relatively simple to manufacture. The reactor cores can be spirally wound of magnetic strips and the slots can be easily machined into the end faces of the core. The cores can, alternatively, be made of molded or ground ferrites. The cores are preferably toroidal in shape, although the invention covers cores of any shape having slots formed therein as described above. Mechanical coupling devices are entirely eliminated. Manufacture is simple, rapid and inexpensive. A single unitary mechanical structure of good strength is attained.

The width of the slots should be kept substantially less than the cross-sectional dimensions of the core to minimize fringing. The core winding is wrapped around the end faces of the core but cannot enter the relatively narrow slots. This structure ensures reliable, effective stabilization of the saturated reactor under normal operating conditions.

The present invention may be embodied in other specific forms without departing from the spirit or essential attributes thereof and, accordingly, reference should be made to the appended claims, rather than to the foregoing specification, as indicating the scope of the invention.

I claim:

1. A stabilized saturated reactor, comprising:

a core of magnetic material having an inner peripheral surface and an outer peripheral surface, a slotted end surface intermediate said inner and outer peripheral surfaces, and an unslotted end surface intermediate said inner and outer peripheral surfaces, said slotted end surface being provided with plural spaced slots, each of said slots being open along said slotted end surface from said inner peripheral surface to said outer peripheral surface, each of said slots extending from said slotted end surface along the axial dimension of the core to a depth less than one-half the axial dimension of the core, each of said slots having a width substantially less than the cross-sectional dimensions of said core, a winding connectable to an AC source, said winding surrounding said peripheral surfaces and said end surfaces, the cross-section of said winding being greater than said width of each of said slots, whereby said winding when connected to said AC source establishes an unsaturated magnetic field through the volume of said core between said slotted end surface and approximately the depth of said slots and a saturated magnetic field through the volume of said core between said unslotted end surface and approximately the depth of said slots.

2. A linear reactor, comprising:

a core of magnetic material having an inner peripheral surface and an outer peripheral surface, a pair of oppositely disposed slotted end surfaces intermediate said inner and outer peripheral surfaces, each of said slotted end surfaces being provided with plural spaced slots, each of said slots being open along the slotted end surface associated with the slot from said inner peripheral surface to said outer peripheral surface, each of said slots extending from the slotted end surface associated with the slot along the axial dimension of the core to a depth less than one-half the axial dimension of the core, said spaced slots in one end surface being staggered in relation to said spaced slots in the other end surface, a winding connectable to an AC source, said winding surrounding said peripheral surfaces and said end surfaces, the cross-section of said winding being greater than said width of each of said slots, whereby said winding when connected to said AC source establishes an unsaturated magnetic field through the volume of said core.

3. The linear reactor according to claim 2 wherein said slots of said one end surface and said slots of said other end surface are staggered by approximately said slot width.

4. The linear reactor of claim 2 wherein said reactor has a reactance R proportional to:

$$n^2 \times h' \times w'/g \times N$$

where n is the number of turns of said winding, h is the height of said core, w is the width of said core, g is the width of each of said slots, and N is the number of slots per end surface.

5. A stabilized saturated reactor, comprising:

a slotted core of magnetic material having an inner peripheral surface and an outer peripheral surface, a pair of oppositely disposed slotted end surfaces intermediate said inner and outer peripheral surfaces, each of said slotted end surfaces being provided with plural spaced slots, each of said slots being open along the slotted end surface associated with the slot from said inner peripheral surface to said outer peripheral surface, each of said slots extending from the slotted end surface associated with the slot along the axial dimension of the core to a depth less than one-half the axial dimension of the core, said spaced slots in one end surface being staggered in relation to said spaced slots in the other end surface, an unslotted core spaced axially from the slotted core by a distance greater than approximately four times the width of each of the slots in tle slotted core, a winding connectable to an AC source, said winding surrounding the slotted core and the unslotted core, the cross-section of said winding being greater than the width of each of said slots in said slotted core, whereby said winding when connected to said AC source establishes an unsaturated magnetic field through the volume of said slotted core and a saturated magnetic field through the volume of said unslotted core.

6. A stabilized saturator reactor, comprising:

a toroidal core of magnetic material having an inner peripheral surface and an outer peripheral surface, a slotted end surface intermediate said inner and outer peripheral surfaces, and an unslotted end surface intermediate said inner and outer peripheral surfaces, said slotted end surface being provided with plural circumferentially spaced slots each of which extend in a substantially radial plane with respect to the central axis of said core, each of said slots being open along said slotted end surface from said inner peripheral surface to said outer peripheral surface, each of said slots extending from said slotted end surface along the axial dimension of the core to a depth less than one-half the axial dimension of the core, each of said slots having a width substantially less than the cross-sectional dimensions of said core, a winding connectable to an AC source, said winding surrounding said peripheral surfaces and said end surfaces, the cross-section of said winding being greater than said width of each of said slots, whereby said winding when connected to said AC source establishes an unsaturated magnetic field through the volume of said core between said slotted end surface and approximately the depth of said slots and a saturated magnetic field through the volume of said core between said unslotted end surface and approximately the depth of said slots.

7. A linear reactor comprising:

a toroidal core of magnetic material having an inner peripheral surface and an outer peripheral surface, a pair of oppositely disposed slotted end surfaces intermediate said inner and outer peripheral surfaces, each of said slotted end surfaces being provided with plural circumferentially spaced slots, each of said slots being open along the slotted end surface associated with the slot from said inner peripheral surface to said outer peripheral surface, each of said slots extending from the slotted end surface associated with the slot along the axial dimension of the core to a depth less than one-half the axial dimension of the core, said spaced slots in one end surface being staggered circumferentially in relation to said spaced slots in the other end surface, a winding connectable to an AC source, said winding surrounding said peripheral surfaces and said end surfaces, the cross-section of said winding being greater than the width of each of said slots, whereby said winding when connected to said AC source establishes an unsaturated magnetic field through the volume of said core.

8. A stabilized saturated reactor, comprising:

a slotted toroidal core of magnetic material having an inner peripheral surface and an outer peripheral surface, a pair of oppositely disposed slotted end surfaces intermediate said inner and outer peripheral surfaces, each of said slotted end surfaces being provided with plural circumferentially spaced slots, each of said slots being open along the slotted end surface associated with the slot from said inner peripheral surface to said outer peripheral surface, each of said slots extending from the slotted end surface associated with the slot along the axial dimension of the core to a depth less than one-half the axial dimension of the core, said spaced slots in one end surface being staggered circumferentially in relation to said spaced slots in the other end surface, an unslotted toroidal core spaced axially from said slotted core by a distance greater than approximately four times the width of each of said slots in said slotted core, a winding connectable to an AC source, said winding surrounding said slotted core and said unslotted core, the cross-section of said winding being greater than said width of each of said slots, whereby said winding when connected to said AC source establishes an unsaturated magnetic field through the volume of said slotted core and a saturated magnetic field through the volume of said unslotted core.

* * * * *